US008340368B2

(12) United States Patent
Lee et al.

(10) Patent No.: US 8,340,368 B2
(45) Date of Patent: Dec. 25, 2012

(54) FACE DETECTION SYSTEM

(75) Inventors: Byoung Joon Lee, Seoul (KR); Eui Yoon Chung, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 669 days.

(21) Appl. No.: 12/344,924

(22) Filed: Dec. 29, 2008

(65) Prior Publication Data

US 2009/0310818 A1 Dec. 17, 2009

(30) Foreign Application Priority Data

Jun. 11, 2008 (KR) ..... 10-2008-0054836
Sep. 5, 2008 (KR) ..... 10-2008-0087666

(51) Int. Cl.
*G06K 9/00* (2006.01)

(52) U.S. Cl. ..... 382/118; 382/100; 382/201; 382/206; 382/220; 706/20; 280/730.1; 702/155; 340/815.77

(58) Field of Classification Search ..... None
See application file for complete search history.

(56) References Cited

U.S. PATENT DOCUMENTS 5,680,474 A * 10/1997 Iijima et al. ..... 382/154
6,433,816 B1 * 8/2002 Lee ..... 348/148
7,477,758 B2 * 1/2009 Piirainen et al. ..... 382/100
7,613,328 B2 * 11/2009 Boregowda et al. ..... 382/105
2006/0018641 A1 * 1/2006 Goto et al. ..... 396/4
2006/0115119 A1 * 6/2006 Nagaoka et al. ..... 382/104
2007/0133879 A1 * 6/2007 Fukaya et al. ..... 382/190

FOREIGN PATENT DOCUMENTS

JP 06-217314 8/1994
JP 08-068630 3/1996
JP 2000-280780 A 10/2000
JP 2001-338296 A 12/2001

* cited by examiner

*Primary Examiner* — John Lee
(74) *Attorney, Agent, or Firm* — Edwards Wildman Palmer LLP; Peter F. Corless

(57) ABSTRACT

The present invention relates to a face detection system for a vehicle. At least one first lighting unit is configured to radiate infrared light onto a left side of a driver's face. At least one second lighting unit is configured to radiate infrared light onto a right side of the driver's face. An image capturing unit separately captures the driver's face onto which the infrared light is radiated from the first and second lighting units. A control unit acquires left and right images of the face from the image capturing unit, and obtains a difference image between the acquired left and right images, thus determining whether the driver is inattentive in looking ahead. The system stably performs the face detection function with no or less effect by external optical environments as well as reduced computational load.

6 Claims, 7 Drawing Sheets

FACE DETECTION SYSTEM

CROSS-REFERENCE TO RELATED APPLICATIONS

This application claims under 35 U.S.C. §119(a) priority to Korean Application No. 10-2008-0054836, filed on Jun. 11, 2008, the disclosure of which is incorporated herein by reference in its entirety.

BACKGROUND

1. Technical Field

The present invention relates generally to a face detection system, and, more particularly, to a face detection system for a vehicle, which can improve detection performance while reducing computational load required for the determination of whether a driver of the vehicle is inattentive.

2. Related Art

Generally, a vehicle is provided with a face detection system, which has been used as an element for determining whether a driver dozes off while driving or whether the driver intends to change a lane.

A conventional face detection system includes an image camera for capturing a face, and a control unit for determining whether a driver is inattentive in looking ahead by analyzing the face captured by the image camera.

When the face is captured by the image camera and a captured facial image is input to the control unit, the control unit detects a facial region by binarizing the input image, and thus detects an edge shape, such as a facial contour, from the facial region. Thereafter, the control unit detects detailed elements of the face, such as the eyes, nose, mouth, etc., from an edge-shaped image, and calculates an angle of orientation of the face, thus determining whether the driver is inattentive in looking ahead.

However, in order to detect the eyes, nose, mouth, etc., precise detection must be performed. The conventional system is inevitably sensitive to variation in various external optical environments. As a result, there is a problem in that the performance of the detection of respective elements is deteriorated, thus resulting in a deterioration of the performance of the determination of whether the driver is inattentive in looking ahead.

Further, the conventional face detection system calculates an orientation angle of a face through the detection of a facial region, the extraction of an edge-shaped image, and the detection of respective elements, thus determining whether the driver is attentive in looking ahead. Accordingly, there is a problem in that computational load required for such a process greatly increases, so that it is difficult to implement the face detection system in an embedded system in real time. To overcome the problem, a high quality clock and high priced Central Processing Unit (CPU) is required, which increases costs required for the face detection.

The above information disclosed in this Background section is only for enhancement of understanding of the background of the invention and therefore it may contain information that does not form the prior art that is already known in this country to a person of ordinary skill in the art.

SUMMARY

Accordingly, the present invention has been made keeping in mind the above problems occurring in the prior art, and an object of the present invention is to provide a face detection system, which can prevent the performance of the determination of whether a driver is inattentive in looking ahead from being deteriorated due to external optical variation.

Another object of the present invention is to provide a face detection system, which can improve detection performance while reducing computational load required for the determination of whether the driver is inattentive in looking ahead.

In order to accomplish the above objects, the present invention provides a face detection system for a vehicle, comprising: at least one first lighting unit for radiating infrared light onto a left side of a driver's face; at least one second lighting unit for radiating infrared light onto a right side of the driver's face; an image capturing unit for separately capturing the driver's face onto which the infrared light is radiated from the first lighting unit or units and the second lighting unit or units; and a control unit for acquiring left and right images of the face from the image capturing unit, and obtaining a difference image between the acquired left and right images, thus determining whether the driver is inattentive in looking ahead.

Preferably, the control unit may acquire left and right binary images by binarizing the acquired left and right images, and may obtain the difference image from the binary images.

Preferably, the control unit may acquire a mirrored image by mirroring one of the left and right binary images, and may obtain the difference image by performing subtraction between the mirror image and a remaining binary image.

Preferably, the first lighting unit or units and the second lighting unit or units may be sequentially operated.

Preferably, the first lighting unit or units and the second lighting unit or units may be near-infrared light emitting diodes, and are installed ahead of, above a driver's seat, or both.

Preferably, the first lighting unit or units may be installed to be symmetrical to the second lighting unit or units with respect to a front side of the driver's face.

Preferably, the image capturing unit may be a Charge Coupled Device (CCD) camera equipped with an infrared pass filter.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Hereinafter, embodiments of the present invention will be described in detail with reference to the attached drawings.

Figure 1:
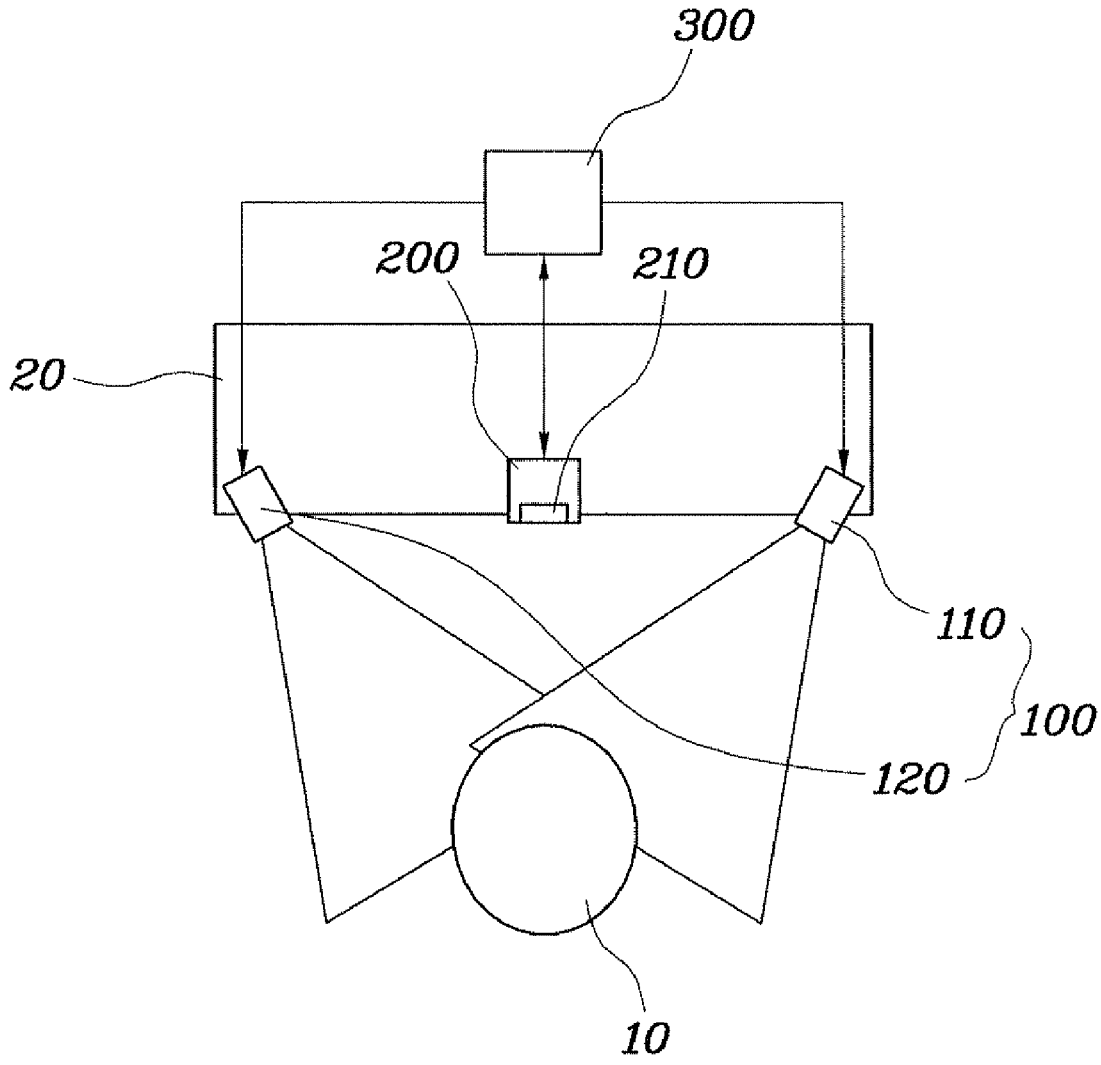
FIG. 1 is a block diagram showing a face detection system according to an embodiment of the present invention.

Referring to FIGS. 1 and 2, the face detection system according to an embodiment of the present invention includes a lighting unit 100 for radiating infrared light onto a driver's face 10, an image capturing unit 200 for capturing the driver's face 10 onto which the infrared light is radiated from the lighting unit 100, and a control unit 300 for performing image processing on images captured by the image capturing unit 200, and determining whether the driver is inattentive in looking ahead.

The lighting unit 100 is installed on a structure placed ahead of the driver and configured to radiate infrared light, for example, near-infrared light, onto the driver's face 10. The lighting unit 100 includes a plurality of lighting subunits. For example, it may include one or more first lighting subunits 110 for radiating infrared light onto a right side of the driver's face 10 and one or more second lighting subunits 120 for radiating infrared light onto a left side of the driver's face 10. Preferably, as shown in FIG. 1, it may include a first lighting subunit 110 for radiating infrared light onto a right side of the driver's face 10 and a second lighting subunit 120 for radiating infrared light onto a left side of the driver's face 10.

The first lighting subunit 110 and the second lighting subunit 120 may be independently installed at locations forming a predetermined angle, for example, 30 to 60 degrees, with respect to the front side of the driver's face. Preferably, they are installed at locations forming an angle of 45 degrees with respect to the front side of the driver's face 10. At this time, the first lighting subunit 110 and the second lighting subunit 120 are, suitably, installed to be symmetrical with respect to the front side of the driver's face so that infrared light can be uniformly radiated onto the right and left sides of the driver's face.

In this case, as the lighting unit 100 for radiating infrared light onto the driver's face 10, Infrared Light Emitting Diodes (IR LEDs) may be used.

Figure 2A:
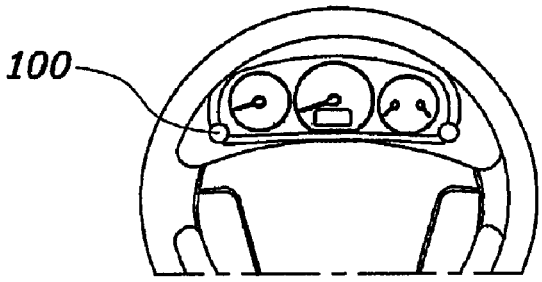
FIGS. 2A to 2D are diagrams showing locations at which the lighting units of a face detection system are installed according to an embodiment of the present invention.
Figure 2B:
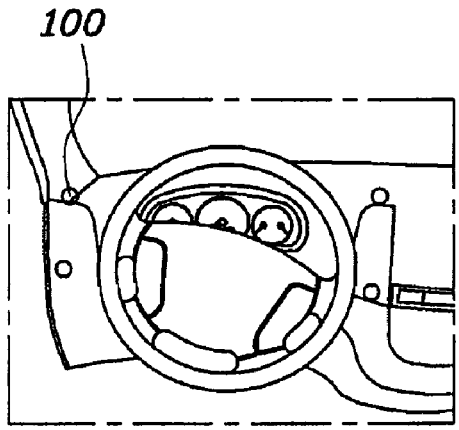
Figure 2C:
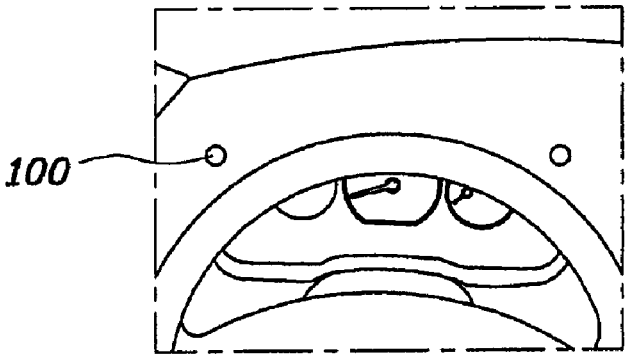
Figure 2D:
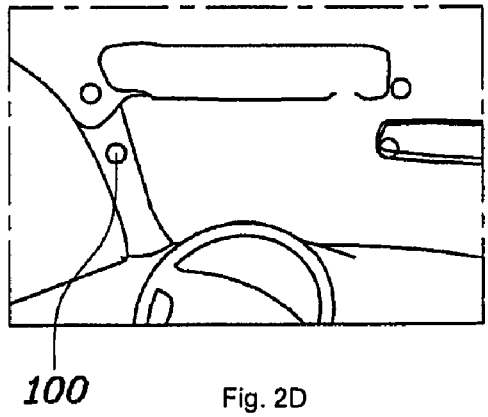
Figure 3:
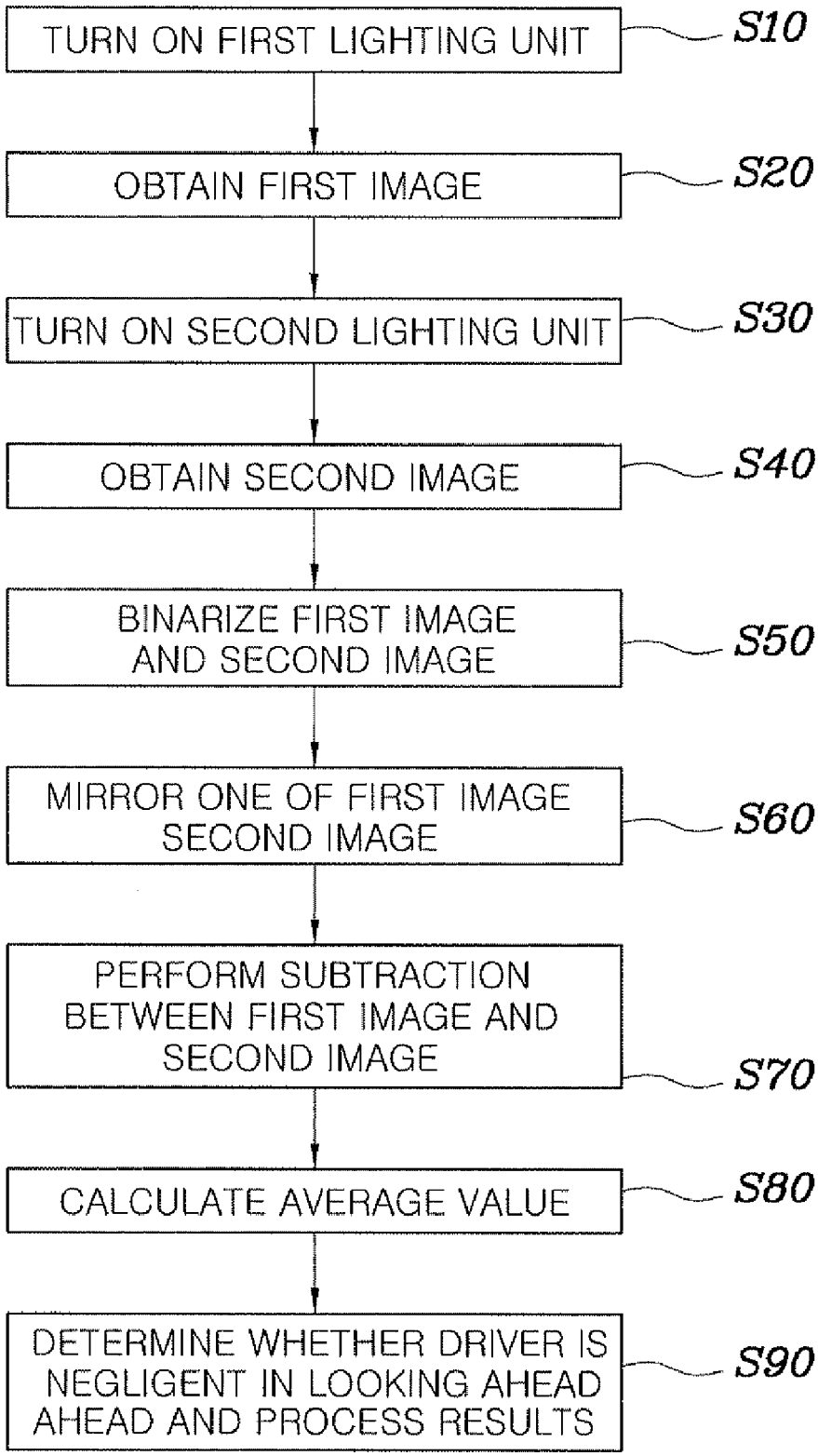
FIG. 3 is a block diagram showing the operation of a face detection system according to an embodiment of the present invention.
Figure 4:
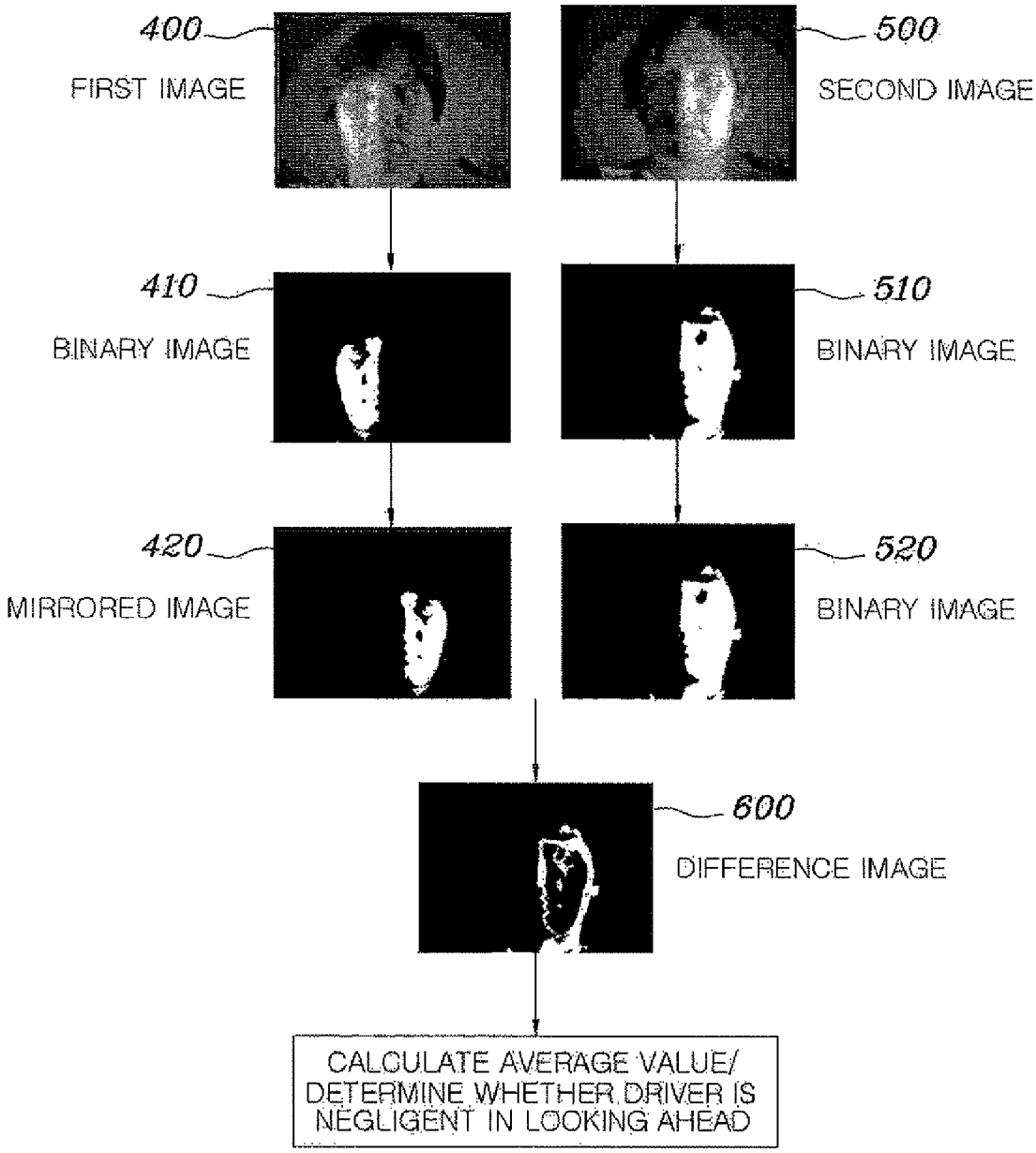
FIG. 4 is a diagram showing features obtained through the operation of a face detection system according to an embodiment of the present invention.

As described above, the number of the first and second lighting subunits is not limited, two or more lighting subunits may be installed in various ways. As shown in FIG. 2A, for example, the lighting subunits may be installed on both sides of a lower portion of an instrument cluster formed ahead of a driver's seat. Further, as shown in FIG. 2B, the lighting subunits may be installed at locations above or below both vents of the air conditioner of the driver's seat. Further, as shown in FIG. 2C, the lighting subunits may be installed on both sides of a dashboard above an instrument cluster. As shown in FIG. 2D, the lighting subunits may also be installed on both sides of a sun visor placed above a driver's seat, or the left sides of an A-pillar and a room mirror.

The first lighting subunit 110 and the second lighting subunit 120 sequentially radiate infrared light onto the driver's face 10. Through the lighting subunits 110 and 120, infrared light is radiated around the left and right sides of the driver's face.

The image capturing unit 200 is installed ahead of the driver's seat so that the front side of the driver's face 10 can be captured, and functions to separately capture the sides of the driver's face onto which the infrared light is radiated from the first lighting subunit 110 and the second lighting subunit 120.

Such an image capturing unit 200 is configured in such a way that a near-infrared pass filter 210 is mounted on a Charge Coupled Device (CCD) camera, and is operated to block sunlight, flowing thereinto from the outside of a vehicle, and other externally illuminated light beams and to acquire only near-infrared images. If the lighting unit 100, such as near-infrared LEDs, does not exist, no images can be acquired.

The control unit (Electronic Control Unit: ECU) 300 is connected to the image capturing unit 200 and is configured to perform image processing on the images acquired by the image capturing unit 200 and to determine whether the driver is inattentive in looking ahead.

That is, the control unit 300 acquires binary images by binarizing respective infrared images acquired by the image capturing unit 200, acquires a mirrored image by mirroring one of the binary images, obtains a difference image by performing subtraction between the mirrored image and the remaining binary image, and calculates an average value of the obtained difference image, thus determining whether the driver is inattentive in looking ahead.

Further, the control unit 300 may be connected to the lighting unit 100, and may perform control such that infrared light is sequentially radiated onto the driver's face 10 through such a connection.

Hereinafter, the operation of the face detection system according to the present invention is described in detail with reference to FIGS. 3 to 7.

First, the control unit 300 turns on the first lighting subunit 110 at step S10. In this case, the first lighting subunit 110 radiates near-infrared light onto the right side of the driver's face, and the image capturing unit 200 acquires a first image 400 by capturing the driver's face onto which the near-infrared light is radiated at step S20.

Next, the control unit 300 turns on the second lighting subunit 120 at step S30, where the second lighting subunit 120 radiates near-infrared light onto the left side of the driver's face. The image capturing unit 200 acquires a second image 500 by capturing the face onto which the near-infrared light is radiated at step S40. At this time, the first lighting subunit 110 is turned off while the second lighting subunit 120 is turned on.

Next, when the first image 400 and the second image 500 are input to the control unit 300, the first image 400 and the second image 500 are binarized for respective pixels so that bright portions of the driver's face can be extracted at step S50. Therefore, the control unit 300 acquires binary images 410 and 510 by binarizing the first image 400 and the second image 500, respectively.

Thereafter, one of the binary image 410 of the first image and the binary image 510 of the second image is mirrored so that the face, viewed in the same direction, is detected at step S60. Accordingly, a mirrored image 420 is acquired by mirroring one of the binary image 410 of the first image and the binary image 510 of the second image. Here, solely for the purpose of simplicity and illustration, the case where the binary image 410 of the first image is mirrored is described.

Next, subtraction is performed between the values of pixels of the mirrored image 420 and a binary image 520 at step S70, so that the control unit 300 obtains a difference image 600 indicating the difference between the two images.

Thereafter, an average value of the pixels of the difference image 600 is calculated, and thus the orientation of the driver's face is calculated.

Next, whether the driver is inattentive in looking ahead is determined depending on the calculated orientation of the driver's face, and then the operation of the face detection system is terminated.

Figure 5:
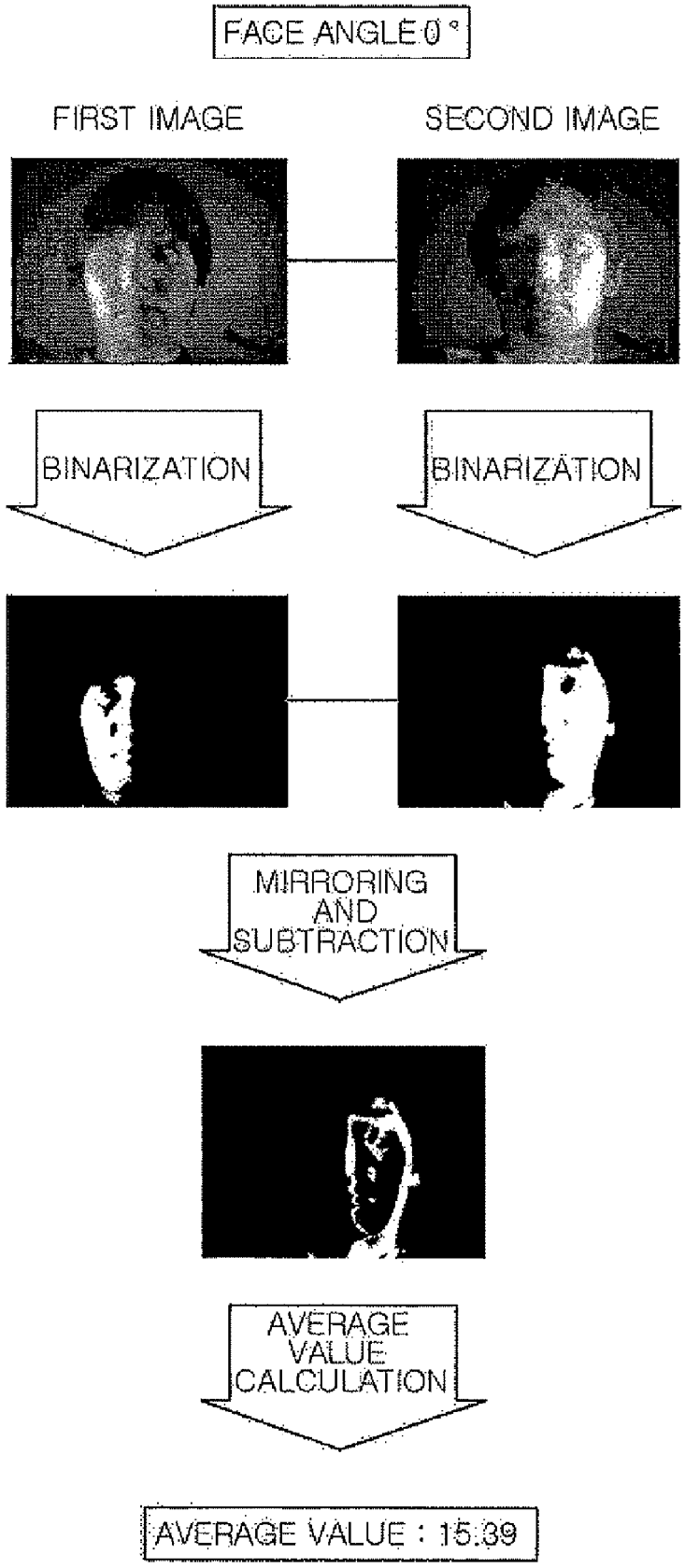
FIGS. 5 to 7 are diagrams showing the results of simulations of a face detection system according to an embodiment of the present invention.

As shown in FIG. 5, as a result of experiments conducted when an angle of the face is 0 degrees, an average value obtained by the face detection system of the present invention is measured as 15.39, whereby it can be determined that the driver's face almost looks directly straight ahead.

Figure 6:
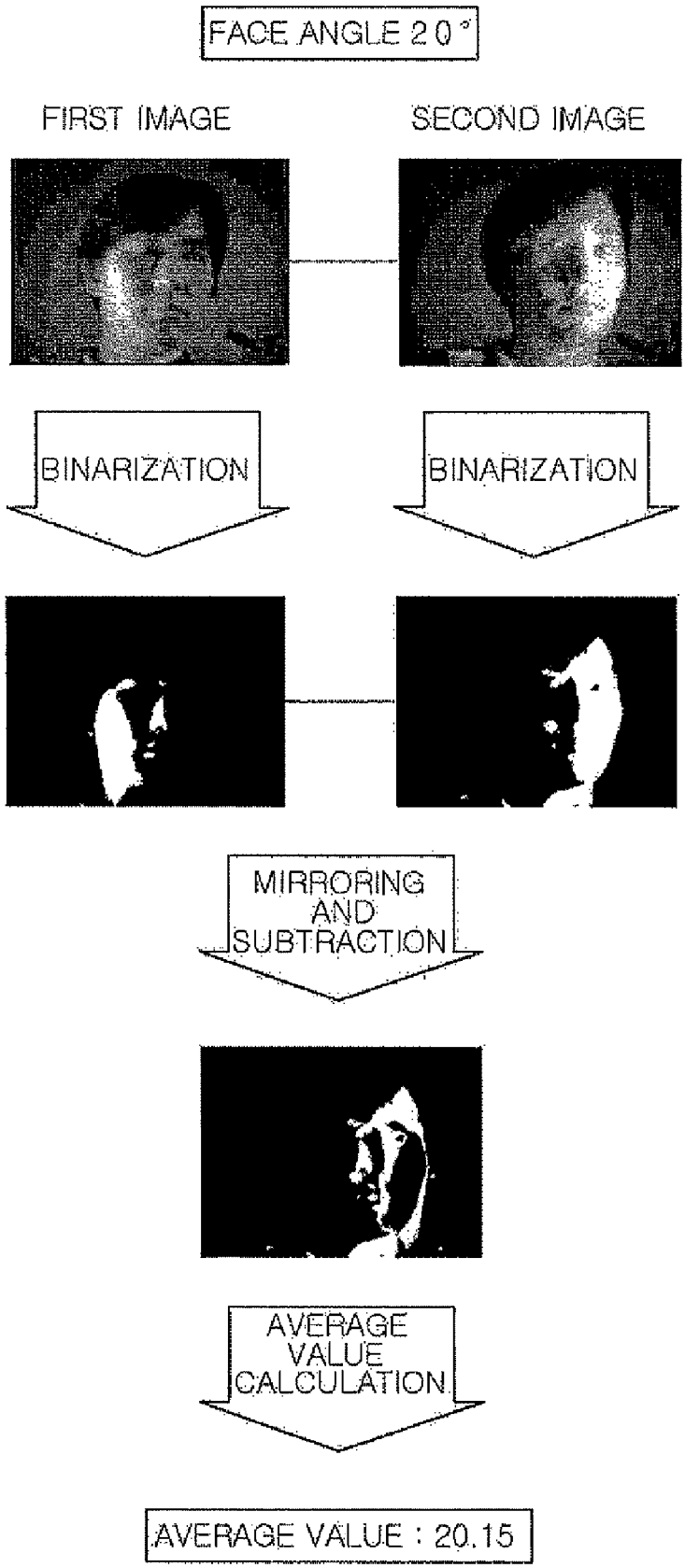

Further, as shown in FIG. 6, as a result of experiments conducted when the face is inclined to the left at an angle of 20 degrees, an average value obtained by the face detection system of the present invention is measured as 20.15, whereby it can be determined that the driver's face is inclined to the left at an angle of about 20 degrees.

Figure 7:
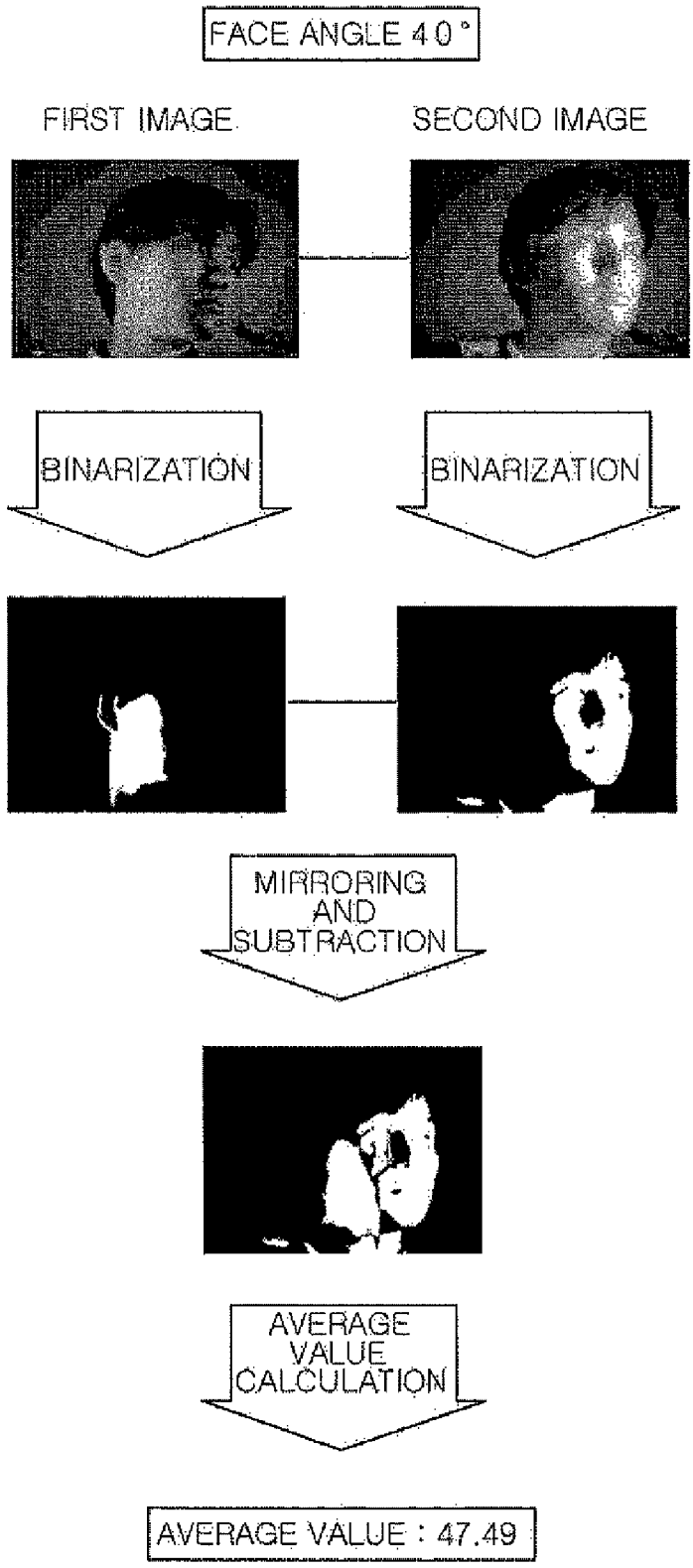

Further, as shown in FIG. 7, as a result of experiments conducted when the face is inclined to the left at an angle of 40 degrees, an average value obtained by the face detection system of the present invention is measured as 47.49, whereby it can be determined that the driver's face is inclined to the left at an angle of about 40 degrees.

Accordingly, the face detection system according to the present invention is advantageous in that it can improve face detection performance while reducing computational load required for the detection of a face.

As described above, the present invention is advantageous in that, since whether a driver is inattentive in looking ahead is merely determined using near-infrared images, performance of the determination of whether the driver is inattentive in looking ahead can be improved regardless of external optical environments.

Further, the present invention is advantageous in that whether a driver is inattentive in looking ahead is determined using only near-infrared light reflected from a face, thus reducing computational load required for the determination of whether the driver is inattentive in looking ahead.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A face detection system for a vehicle, comprising:

at least one first lighting unit and at least one second lighting unit configured to sequentially radiate infrared light onto a left and right side of the driver's face;

an image capturing unit configured to separately capture right and left images of the driver's face onto which the infrared light is radiated from the at least one first lighting unit and the at least one second lighting; and a control unit configured to acquire the left and right images of the face from the image capturing unit, obtain a difference image between the acquired left and right images, and determine whether the driver is inattentive in looking ahead based on the difference image obtained, wherein the control unit acquires left and right binary images by binarizing pixels of the acquired left and right images captured by the capturing unit to identify bright portions of the driver's face, obtains the difference image from the left and right binary images and calculates an average value of pixels of the difference image to determine whether a driver is looking ahead or not.

2. The face detection system according to claim 1, wherein the control unit acquires a mirrored image by mirroring one of the left and right binary images, and obtains the difference image by performing subtraction between the mirror image and a remaining binary image.

3. The face detection system according to claim 1, wherein the first lighting unit or units and the second lighting unit or units are sequentially operated.

4. The face detection system according to claim 1, wherein the first lighting unit or units and the second lighting unit or units are near-infrared light emitting diodes, and are installed ahead of, above a driver's seat, or both.

5. The face detection system according to claim 4, wherein the first lighting unit or units are installed to be symmetrical to the second lighting unit or units with respect to a front side of the driver's face.

6. The face detection system according to claim 1, wherein the image capturing unit is a Charge Coupled Device (CCD) camera equipped with an infrared pass filter.

* * * * *